United States Patent [19]

Lanting et al.

[11] 4,440,455

[45] Apr. 3, 1984

[54] DRAWER GLIDE MOUNT

[75] Inventors: Richard J. Lanting, Grand Rapids; Bruce A. Rentz, Kentwood, both of Mich.

[73] Assignee: Westinghouse Electric Corp., Pittsburgh, Pa.

[21] Appl. No.: 384,702

[22] Filed: Jun. 3, 1982

[51] Int. Cl.[3] ..... F16C 29/00

[52] U.S. Cl. ..... 308/3.8; 312/339; 312/341 R; 312/350

[58] Field of Search ..... 308/3.6, 3.8; 312/330 R, 334, 338, 341 R, 341 NR, 342, 343, 344, 345, 348, 349, 350; 248/222.2, 222.3, 248, 251; 211/105.1, 105.3, 123

[56] References Cited

U.S. PATENT DOCUMENTS

| | | | |
|---|---|---|---|
| 3,080,980 | 3/1963 | Gibbons | 248/222.3 X |
| 3,205,025 | 9/1965 | Jordan | 308/3.8 |
| 3,352,617 | 11/1967 | Dargene | 308/3.8 X |
| 3,701,577 | 10/1972 | Fischer | 308/3.6 X |
| 3,716,284 | 2/1973 | Vogt | 312/350 X |
| 4,344,593 | 8/1982 | Canto | 248/222.2 X |

*Primary Examiner*—Stuart S. Levy
*Assistant Examiner*—David Werner
*Attorney, Agent, or Firm*—B. R. Studebaker

[57] ABSTRACT

A drawer glide mount for mounting a drawer glide to the interior surface of a drawer cabinet side wall which includes a pair of mounting tabs secured to the cabinet side wall having slots therein which receive complementary blade extensions on the drawer glide to provide locking engagement of the drawer glide with the drawer cabinet side wall.

4 Claims, 2 Drawing Figures

FIG. 1
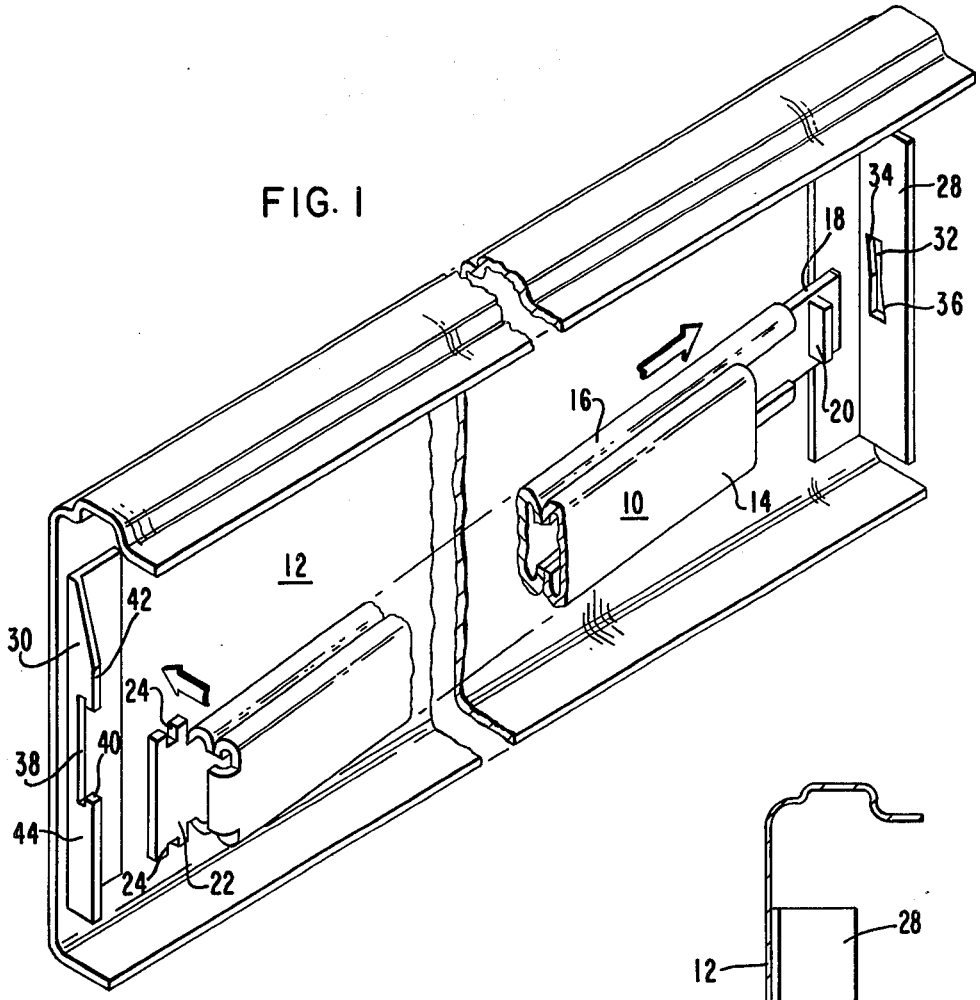
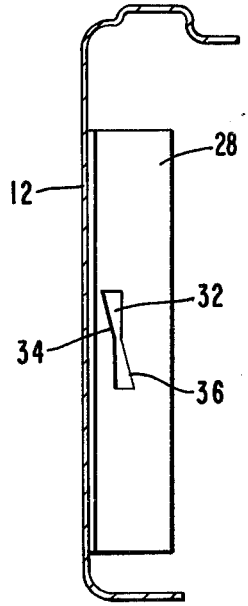
FIG. 5

DRAWER GLIDE MOUNT

BACKGROUND OF THE INVENTION

This invention relates to drawer glides and more particularly to the mounting of drawer glides to the side wall of the drawer cabinet.

A typical drawer glide is disclosed in U.S. Pat. No. 3,205,025 and basically includes an inner rail mounted to the drawer and an outer rail mounted to the interior of the cabinet side wall with the two rails interconnected for relative movement by a ball bearing intermediate member generally referred to as a ball retainer. Many techniques have been employed to attach the outer rail member or race to the interior of the side wall of the drawer cabinet such as for example self tapping screws or staking. In the case of self tapping screw mounting care must be taken so the screw is not stripped out of its hole due to the repetitive operation of the drawer and staking requires that great care must be taken to provide good staking so that the stake remains in place after many cycles of the glide.

Since both of the prior art processes require care in assembling the drawer glide to the cabinet side wall, assembly time during the manufacturer of the drawer takes longer than is desirable in providing an economic product. With mounting tabs prewelded to the cabinet side wall or formed integrally therewith during the manufacture of the side wall, the drawer glide mounting system of the present invention can significantly reduce assembly time and therefore manufacturing cost as well as providing a relatively failure proof mount.

SUMMARY OF THE INVENTION

In accordance with the present invention a drawer glide is quickly and easily assembled to the interior surface of the side wall of a drawer cabinet through a simple key and keyslot locking system. The mounting of a drawer glide to the interior surface of a drawer cabinet is accomplished in accordance with the present invention by providing a first mounting tab secured to the inner surface of a cabinet side wall adjacent one end thereof which tab includes a keyslot in the outer edge thereof comprising an elongated slot of a first vertical dimension and an entrance opening of a lesser vertical dimension. A second mounting tab is secured to the inner surface of the cabinet side wall adjacent to the other end thereof with the second mounting tab including a slot therethrough which has an upwardly and outwardly diverging side edge in its upper half and a downwardly and outwardly diverging opposite side edge in its lower half. The ball bearing type drawer glide is provided with blade extensions on each end thereof with one blade extension having a stop member extending normal thereto while the other blade extension has a pair of cutout notches in the top and bottom edges forming a key, with the distance between the bottom edges of the notches being of a dimension greater than the vertical dimension of the entrance opening in the first mounting tab but less than the vertical dimension of the elongated slot. The first blade extension is inserted into the slot in the second mounting tab until the stop abuts the tab and the glide is rotated slightly to permit the key to enter the keyslot with subsequent rotation back to the vertical of the glide and downward motion of the key in the elongated slot locking the glide to the wall of the cabinet.

BRIEF DESCRIPTION OF THE DRAWING

Many of the attendant advantages of the present invention will become more readily apparent and better understood as the following detailed description is considered in connection with the accompanying drawing in which:

FIGS. 1, 2 and 3 are perspective views illustrating sequentially the mounting of a drawer glide to the interior surface of a drawer cabinet in accordance with the present invention;

FIG. 5 is a front elevation view, partly in section, of the rear mounting tab and drawer cabinet side wall.

DESCRIPTION OF THE PREFERRED EMBODIMENT

Figure 2:
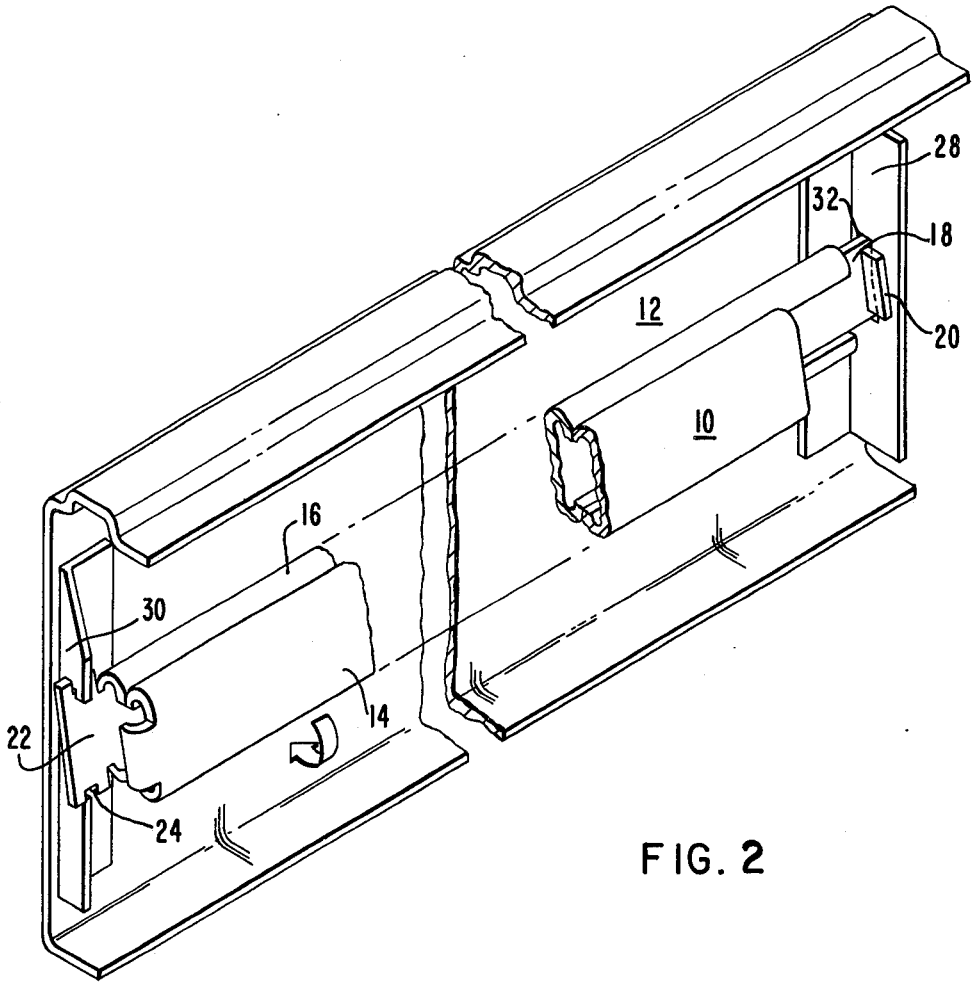
Figure 3:
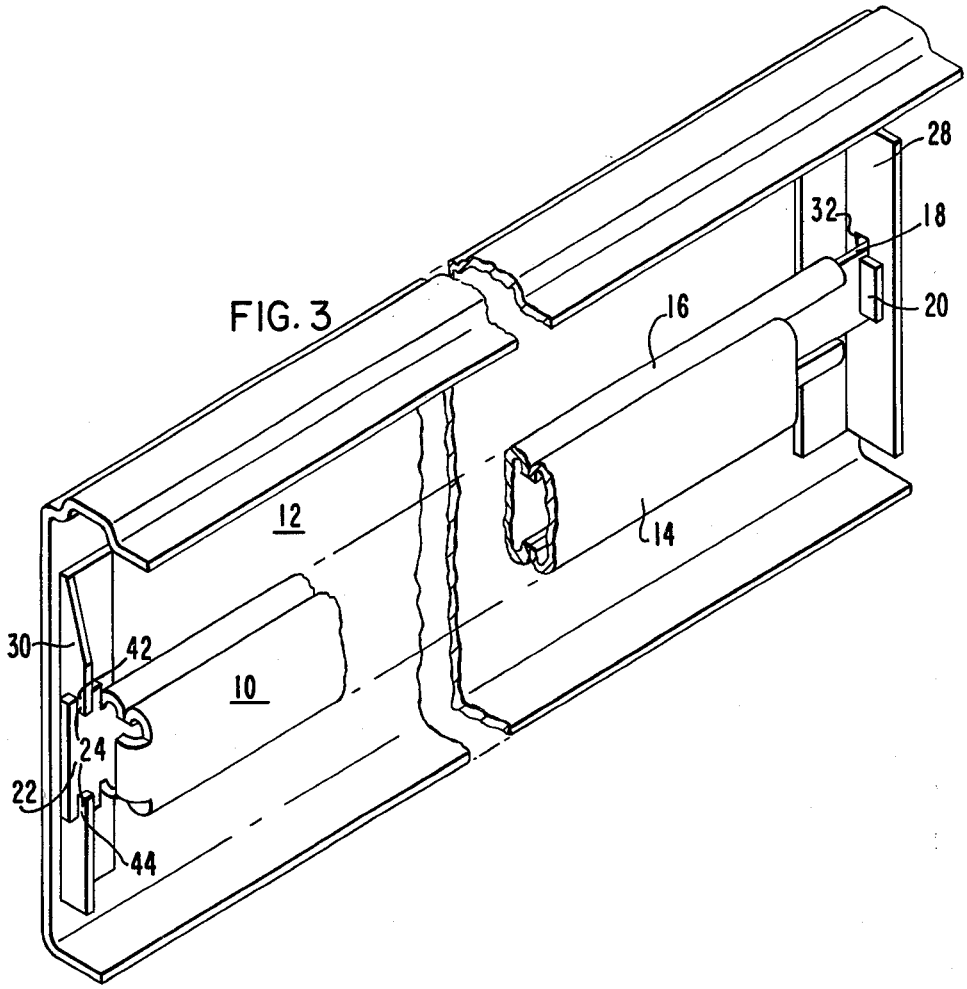
Figure 4:
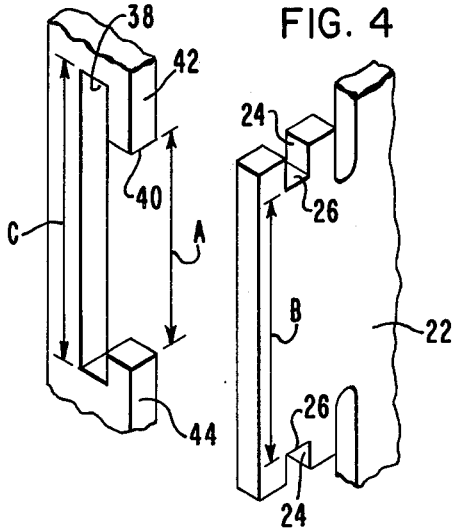
FIG. 4 is a perspective view illustrating the key and keyslot of the drawer glide and mounting tab.

Referring now in detail to the drawings wherein like reference characters represent like parts throughout the several views, there is illustrated in FIGS. 1 through 3 the assembling of a drawer glide generally designated 10 to the side wall of a drawer cabinet generally designated 12. The drawer glide 10 includes an inner rail 14 and an outer rail 16 interconnected by a ball bearing carriage (not shown) and is essentially of the type shown and described in U.S. Pat. No. 3,205,025 to Jordan. The conventional drawer glide is modified by providing blade extensions on each end of the outer rail 16. At the rearward end of the glide a planar blade extension 18 includes a stop member 20 thereon extending perpendicular to the plane of the blade member 18. At the other end or front end of the glide the blade extension 22 is somewhat wider than the blade extension 18 and includes square cut notches 24 oppositely disposed in the upper and lower edges of the blade portion 22. The bottoms 26 of the notches 24 are spaced apart a predetermined distance B and form a key, the operation of which will be later described.

The interior surface of the drawer cabinet is provided with a pair of mounting tabs 28 and 30 which are mounted adjacent the rear and front ends of the drawer cabinet side wall respectively, but which could obviously be reversed if the blades on the drawer glide were reversed. As can be best seen in FIG. 5, the rearward mounting tab 28 includes an elongated vertical slot 32 therethrough which has for the upper half of the slot on one side a side edge that diverges upwardly and outwardly to form a ramp 34 and on the other side in its lower half a side edge which diverges downwardly and outwardly to form a ramp 36.

The mounting tab 30 adjacent the front end of the cabinet side wall includes a substantially C-shaped keyslot in the outer edge of the tab comprising an elongated slot portion 38 having a vertical dimension C and an entrance opening 40 to the elongated slot of a lesser vertical dimension A. The entrance opening 40 is shorter than the elongated slot portion 38 by the combined lengths of the longer, upper retaining lip 42 and the shorter, lower retaining lip 44.

As best illustrated in FIGS. 2 and 3, in order to mount the drawer glide 10 to the cabinet side wall 12 the blade extension 18 is placed through the aperture 32 until the stop member 20 abuts the mounting tab 28. The entire glide rail is rotated slightly until the blade extension 18 abuts the ramps 34 and 36 which will now permit the upper notch 24 to pass the upper retaining lip 42 and enter the upper portion of the elongated slot 38. The guide rail is now rotated toward the vertical (arrow FIG. 2) allowing the lower notch 24 to pass over the lower retaining lip 44 and into a vertical position within the slot 38. The key 22 is then moved downwardly in the slot 38 to lock the glide into the mounting tabs. Since the dimension B is g reater than the dimension A the key 22 is now locked in place behind the upper and lower retaining lips 42, 44. The only way that the key 22 can now be removed from the keyslot 38 is to move the key into the longer upper portion of the slot 38 and rotate the key back through the opening 40. Of course, this is not possible when a drawer is positioned and connected to a pair of inner glide rails 12 and thus disengagement of the glides from the mounting tabs is rendered impossible once the drawer is assembled.

As will be seen from the foregoing the drawer glide mount of this invention provides for the quick and simple assembly of a drawer glide to the side wall of a drawer cabinet and provides a locking relationship between the two that will not become loosened or defective during thousands of cycles of the drawer moving in and out of the drawer cabinet.

What is claimed is:

1. A drawer glide mount for mounting a drawer glide to the interior surface of drawer casing side wall, said drawer glide mount comprising;

front and rear mounting tabs secured to the interior surface of the side wall of said drawer casing adjacent the front and rear ends thereof, one of said mounting tabs including a slot therethrough and the other of said mounting tabs including a keyslot in the side edge thereof, said keyslot comprising an elongated slot of a first vertical dimension and an entrance opening of a lesser vertical dimension, and a drawer glide having a planar extension on one end thereof and an extension having cutout notches in the top and bottom edges thereof forming a drawer glide key therein on the other end thereof, the distance between the base of said notches in the top and bottom edges being greater than the entrance opening in said keyslot whereby when said planar extension is inserted into said slot, said drawer glide key must be rotated into said keyslot for locking engagement with said front and rear mounting tabs.

2. The drawer glide mount according to claim 1 wherein said slot through one of said tabs has an outwardly and upwardly diverging side edge in its upper half and a downwardly and outwardly diverging side edge on the opposite side of its lower half thereby permitting slight rotation of said planar extension within said slot.

3. The drawer glide mount according to claim 2 wherein stop means are provided on said planar extension extending normal thereto for controlling the depth of insertion of said planar extension into said slot.

4. A drawer glide mount for mounting a drawer glide to the interior surface of a drawer cabinet, said drawer glide mount comprising:

a first mounting tab secured to the inner surface of the cabinet side wall adjacent one end thereof, said first mounting tab including a keyslot in the outer edge thereof, said keyslot comprising an elongated slot of a first vertical dimension and an entrance opening of a lesser vertical dimension;

a second mounting tab secured to the inner surface of the cabinet side wall adjacent the other end thereof, said second mounting tab including a slot therethrough, said slot in said second tab including an upwardly and outwardly diverging side edge in its upper half and a downwardly and outwardly diverging opposite side edge in its lower half;

a ball bearing type drawer glide having blade extensions on each end thereof, one of said blade extensions having a stop member extending normal thereto and the other of said blade extensions having cutout notches in the top and bottom edges thereof forming a key, the distance between the bottom edges of said notches being of a dimension greater than the vertical dimension of said entrance opening in said keyslot but less than the vertical dimension of said elongated slot whereby said one of said blade extensions is inserted into said slot in said second mounting tab until said stop abuts said tab and said glide is rotated slightly to permit said key to enter said keyslot with subsequent rotation back to the vertical of said glide and downward motion of said key in said elongated slot locking said guide to the wall of said cabinet.

* * * * *